US009695027B2

(12) United States Patent
Magniet et al.

(10) Patent No.: US 9,695,027 B2
(45) Date of Patent: Jul. 4, 2017

(54) CAPSULE OPENING KIT

(75) Inventors: Ines Magniet, Savigny (CH); Sophie Abraham, Remoray (FR); Stephane Hentzel, Yvonand (CH); Heinz Wyss, Oberdiessbach (CH); Nicole Langenegger, Zurich (CH); Catia Filipa Monteiro Pimenta de Sousa, Lausanne (CH); Marie Georgina Feuvrier-Roy, Chaux-Neuve (FR); Alain Meier, Caneggio (CH)

(73) Assignee: Nestec S.A., Vevey (CH)

( * ) Notice: Subject to any disclaimer, the term of this patent is extended or adjusted under 35 U.S.C. 154(b) by 615 days.

(21) Appl. No.: 13/877,961

(22) PCT Filed: Oct. 5, 2011

(86) PCT No.: PCT/EP2011/067384

§ 371 (c)(1),
(2), (4) Date: Apr. 5, 2013

(87) PCT Pub. No.: WO2012/049052

PCT Pub. Date: Apr. 19, 2012

(65) Prior Publication Data

US 2013/0186046 A1 Jul. 25, 2013

(30) Foreign Application Priority Data

Oct. 12, 2010 (EP) ..... 10187264

(51) Int. Cl.
*B67B 7/00* (2006.01)
*B65D 85/804* (2006.01)

(52) U.S. Cl.
CPC ..... *B67B 7/24* (2013.01); *B65D 85/8043* (2013.01)

(58) Field of Classification Search
CPC .. B67B 7/24; B67B 7/00; B65B 69/00; B65B 29/02; B65D 85/8043
(Continued)

(56) References Cited

U.S. PATENT DOCUMENTS 2,603,859 A * 7/1952 Jensen ..... B67B 7/24 30/448
2,704,885 A * 3/1955 Campbell ..... B67B 7/24 30/446

(Continued)

FOREIGN PATENT DOCUMENTS

DE WO 2009027426 A2 * 3/2009 ..... A47G 19/2205
FR 2905683 3/2008

(Continued)

*Primary Examiner* — Hemant M Desai
*Assistant Examiner* — Valentin Neacsu
(74) *Attorney, Agent, or Firm* — K&L Gates LLP

(57) ABSTRACT

The present invention relates to a kit, comprising: —at least one capsule (10) for insertion in a beverage production machine and containing nutritional ingredients, preferably infant formula ingredients, the capsule having a cup-like base body (10*b*) comprising an opening (11) being closed off by an outlet face (10*c*), and —at least one capsule opening device (1) provided separately to the capsule (10), the capsule (10) and the opening device (1) being provided with means for mechanically associating the opening device (1) to the capsule (10) by the consumer, preferably without using tools, the capsule opening device (1) comprising an integrally formed opening member (2) arranged to be operated by a user and designed for opening said outlet face (10*c*) of the capsule (10).

14 Claims, 6 Drawing Sheets

(58) Field of Classification Search
USPC ..... 53/492, 381.1, 381.2, 381.4; 426/112, 426/115, 123, 389, 394; 81/3.48
See application file for complete search history.

(56) References Cited

U.S. PATENT DOCUMENTS 2,801,464 A * 8/1957 Brownfield ..... B67B 7/24 220/277
4,350,250 A * 9/1982 Peters ..... B65D 5/70 220/279
4,397,879 A * 8/1983 Wilson ..... A47J 43/28 220/266
5,141,133 A * 8/1992 Ninomiya ..... B65D 5/748 222/541.2
6,223,924 B1 * 5/2001 Ek ..... B65D 5/748 215/230
6,364,164 B1 * 4/2002 Troiano ..... B65D 5/748 220/278
2004/0211158 A1 * 10/2004 Miller ..... B43M 5/042 53/468
2006/0011066 A1 1/2006 Bunn
2007/0163122 A1 * 7/2007 Grosh ..... B26B 1/08 30/2
2007/0205198 A1 * 9/2007 Huber ..... B65D 51/222 220/278
2008/0168745 A1 * 7/2008 Collins ..... B67B 7/16 53/235
2010/0308046 A1 * 12/2010 Serra ..... A47G 19/2205 220/212

FOREIGN PATENT DOCUMENTS

FR 2905683 A1 * 3/2008 ..... A47J 31/06
NL 1029906 3/2007
WO 2010026529 3/2010

* cited by examiner

A1
A2
A3
1
1a
1b
1c
3
10
10a
10b
10c
11
12
13
14
15
16
16a
17
18
21
24
A
B
C
P
Z 1
26
13
19
27

5a
27
5
5b
A3
26
1c
13
1b
3

5a
27
5
5b
26
3
13
1c
A4
1b
10c
10

A5
5a
27
13
5
5b
26
10b
1b
1c

A5
5a
27
13
5
5b
26
10b
1b
1c 10
17
27
5
5b
A6
5a
26

A9
A10
A11
A12
A13
A14
A15

CAPSULE OPENING KIT

CROSS REFERENCE TO RELATED APPLICATIONS

The present application is a National Stage of International Application No. PCT/EP2011/067384, filed on Oct. 5, 2011, which claims priority to European Patent Application No. 10187264.6, filed Oct. 12, 2010, the entire contents of which are being incorporated herein by reference.

FIELD OF THE INVENTION

The present invention relates to a capsule for preparing a nutritional product containing nutritional ingredients by mixing the ingredients with a liquid, the capsule being designed for insertion in a device for supplying liquid to the capsule. More particularly, the present invention relates to a kit comprising such a capsule and dedicated opening means for enabling an opening thereof independent of a dedicated preparation device.

BACKGROUND OF THE INVENTION

Nutritional compositions can be, for instance, infant formulas or also nutritional liquids for toddlers, invalids, elderly people, persons having nutritional deficiencies or athletes.

In general, different forms in which nutritional compositions may be provided exist, each of them having their own advantages.

For instance, although the nutritional composition provided in a powder form have a relative high nutritional quality, the preparation thereof may be regarded as inconvenient and time consuming, since water which has been boiled in advanced and allowed to cool has to be poured into a drinking vessel containing the powder in order to prepare a liquid nutritional composition such as an infant formula. The same inconvenient preparation process exists for nutritional compositions in concentrated liquid form.

A more convenient preparation of a nutritional composition is enabled by capsule-based preparation devices in which a single-serving of a preferably powdered composition being provided within a cartridge or capsule is dissolved by means of injection with filtered sanitized liquid such as water. Thereby, any undesired contaminants should be removed from the liquid before the liquid is mixed with the ingredients. For this purpose, such a device preferably comprises filter means for filtering, e.g., sanitizing, the water.

WO2006/077259 for example discloses a method for preparing a single serving of a nutritional composition comprising introducing liquid such as water into a cartridge containing a unit dose, e.g., a single-serving of the composition in concentrated form. Thereby, the water is treated prior to the introduction into the cartridge in order to remove pathogens from the water. This treatment may be for instance a pre-heating, a filtering or an irradiation of the water with ultra-violet light.

WO 008/012314 relates to a device that teaches the principle of treating water by means of a filter used for the preparation of nutritional compositions from a capsule inserted in a dispenser.

A capsule with an integrated antimicrobial filter has been described in WO 2009/092629 and No. 09156782.6 filed on 31 Mar. 2009.

In the known prior art, the nutritional ingredients are generally provided in powdered form within a body portion, specifically a dedicated compartment within such a capsule. The interaction of the ingredients and provided liquid preferably takes place within the capsule, specifically within the dedicated ingredients compartment of the capsule. Thereby, the opening of the usually sealed capsule is obtained by means of a beverage production machine to which the capsule is provided and which is equipped with dedicated opening means.

However, this known method suffers the drawback that for the preparation of the nutritional composition a dedicated beverage production machine is required. However, these beverage production machines are generally not portable and not available in any given place at which the consumer may wish to prepare a nutritional composition. Moreover, the capsule itself does usually not comprise any opening means in order to prevent a user from accidently opening the capsule.

Hence, there is the need for enabling an opening of the capsule by the consumer independent of the beverage production machine.

In particular, the consumer of the nutritional ingredients may wish to open the capsule in order to serve the ingredients to a provided receiving vessel or receptacle such that the consumer is enabled to manually prepare the nutritional composition by means of reconstitution of the ingredients without a beverage production machine, e.g. upon addition of a suitable liquid such as water to the ingredients provided to the receiving vessel.

Moreover, the user may wish to individually choose the dosage, specifically the amount of nutritional ingredients to be served, into a dedicated receiving vessel.

Thus, a portable system is sought-after which enables a consumer to conveniently transport and serve nutritional ingredients contained within a capsule or cartridge.

The present invention seeks to address the above-described problem. The invention also aims at other objects and particularly the solution of other problems as will appear in the rest of the present description.

OBJECT AND SUMMARY OF THE INVENTION

In a first aspect, the present invention relates to a kit, comprising at least one capsule for insertion in a beverage production machine and containing nutritional ingredients, preferably infant formula ingredients, the capsule having a cup-like base body comprising an opening being closed off by an outlet face, and at least one capsule opening device provided separately to the capsule, the capsule and the opening device being provided with means for mechanically associating the opening device to the capsule by the consumer, preferably without using tools, the capsule opening device comprising an integrally formed opening member arranged to be operated by a user and designed for opening said outlet face of the capsule.

The present invention thus provides a kit that enables the fast and convenient opening of an outlet face of the capsule, independent of a beverage production machine. Hence, the user is enabled to conveniently transport the capsule and the capsule opening device of the kit in order to serve the nutritional ingredients provided within the preferably sealed capsule at any given location independent of additional stationary means such as a dedicated beverage production machine.

The at least one capsule of the kit preferably includes nutritional ingredients such as for example infant formula, suitable for interacting with liquid provided to the capsule in order to produce a cold or hot nutritional composition. Thereby, the nutritional ingredients are preferably in the form of a liquid concentrate, a paste, a gel or a powder.

The kit may comprises a large variety of different capsules that preferably differ at least in the amount and/or nature of ingredients contained within the capsule.

The capsule of the kit preferably comprises a cup-like base body having an aperture such that ingredients can be filled to the interior defined by the body of the capsule. The aperture of the body of the capsule is preferably surrounded by a circumferentially arranged flange-like rim portion to which the outlet face is sealed.

It is to be understood that the face covering the aperture of the body of the capsule is referred to as "outlet face" due to its function for being opened by the opening device in order to supply the nutritional ingredients from an opening created within said face. However, said "outlet face" may as well be used as a face for injection of liquid to the capsule when being placed in a dedicated beverage production machine. To this regard, the "outlet face" may as well be referred to as "inlet face" in conjunction with beverage production machines.

The term "without using tools" means that the user may associate the capsule and the capsule opening device of the kit essentially without the help of any additional means which are to be provided to the kit such as a mechanical press or a specific association tool.

The kit may as well comprise a variety of different opening devices that can be chosen by the user to be associated to a particular capsule. Thereby, the opening devices preferably comprise at least different means for mechanically associating the opening device to the capsule by the consumer. Hence, capsules of different shape and/or size of the kit may be associated to and thus opened by means of the provided opening devices.

Moreover, the opening device of the kit may be equipped with opening members of different design and/or size.

Alternatively, the means for mechanically associating the opening device to the capsule by the user may be designed for being adapted to different shapes and/or sizes of the provided capsules.

The opening member of the opening device is preferably arranged in vicinity of the outlet face of the capsule when the opening device and the capsule are in their associated state. Thereby, the opening member comprises any means suitable to at least partially open a face, in particular the outlet face of the capsule.

The opening member comprises any means suitable for pinching, piercing, cutting or rupturing the outlet face of the capsule. In a preferred embodiment, the opening member is a cutting blade suitable for cutting the outlet face of the capsule. The cutting blade preferably comprises a V-edge. However, the cutting blade may as well be of different shape suitable for at least partially cutting the outlet face of the capsule.

The opening member is preferably made from metal or plastic suitable for opening the outlet face of the capsule. In particular, the opening member is preferably a metal or plastic blade suitable for cutting a plastic membrane preferably forming the outlet face of the capsule. More preferably, the opening member is a plastic blade in order to reduce the risk of small pieces being cut from the plastic membrane which may then be present in the composition provided from the capsule.

The opening member is preferably selectively connectable to the opening device and is thus removable, e.g., replaceable. Hence, a user may replace the opening member, for hygiene reasons or because it loses its sharpness.

In a preferred embodiment, the opening member is arranged movably relative to at least the means for mechanically associating the opening device to the capsule.

Moreover, the opening member is preferably arranged movably relative to the outlet face of the capsule when the capsule is associated to the opening device.

In a preferred embodiment, the opening member is designed for being at least brought from a first storage position to a second opening position. Thereby, when the opening member is in its first storage position, it is preferably at least partially retracted within a dedicated support or storage area preferably integrally formed with the opening device. Hence, a user is prevented from cutting himself with the opening member when handling the opening device.

In a second opening position, the opening member is preferably protruding from a face of the opening device adjacent to the outlet face of the capsule when the capsule is associated to the opening device of the kit. Thereby, the opening member preferably protrudes from the device to such an extent that the opening member at least partially penetrates the outlet face of the capsule such that cutting of the outlet face is enabled.

When the opening member is brought from its first storage position to its second opening position, the opening member is preferably moved essentially within a plane parallel to the outlet face of the capsule in case the capsule is associated to the opening device.

The opening member may as well be moved in a direction essentially orthogonal to a plane in which the outlet face of the capsule is arranged when being brought from its first storage position to its second opening position. Hence, penetration, e.g., piercing, of the outlet face by the opening member is obtained.

During further motion in its opening position, the opening member is preferably moved in a direction essentially parallel to the outlet face of the capsule, thereby cutting through the outlet face.

The opening member is designed to follow a predefined motion path with respect to the opening device and thus with respect to the outlet face of the capsule when the capsule is associated to the device. Thereby, the predefined motion path preferably comprises at least the above-described first storage position and the second opening position of the opening member. In a preferred embodiment, the motion path comprises a second storage position. Thereby, the first and the second storage positions are preferably present at the respective ends of the motion path.

The motion path followed by the opening member is preferably in the form of an arc or a quadrant of a circle. Alternatively, the motion path may be of essentially semi-circular form.

Accordingly, the opening means following such a motion path are enabled to at least partially cut the outlet face of the capsule in order to create an aperture, e.g., an opening, therein.

The capsule opening device is preferably a separate element designed to be selectively applicable to the capsule.

Hence, the capsule and the opening device may be stored and transported independently of each other. Accordingly, the user is enabled to associate the capsule and the opening device of the kit directly before opening the capsule. Thus, the risk of a user accidently opening the capsule is significantly reduced. Furthermore, reusability of the opening device is enabled.

The opening device preferably comprises connection means designed for selectively connect and/or disconnect the opening device to/from a rim portion of the capsule. The connection means may however be as well designed to selectively connect the opening device to another portion of the capsule such as e.g. the body portion of the capsule.

The connection means is preferably a connection groove. Thereby, the connection groove is preferably designed for being connected to an outer portion of a face of the capsule such as e.g. a circumferential rim portion of the capsule.

The connection means may as well be any other means suitable for associating the opening device to an ingredients containing capsule of the kit. In particular, the connection means may as well be a snatch member. Thereby, the connection means may comprise two snatch members at opposing side portions of the opening device in order to enable a stable support of the device adjacent to the outlet face of the capsule when being associated to it.

Alternative to a second snatch member, the opening device may as well comprise a joint preferably situated at a position opposite to the snatch member.

Moreover, the connection means may as well be an adhesive. Thereby, the connection means may be in the form of a circumferential adhesive film applied on the capsule and suitable for selectively connecting the opening device to a face of the capsule. The adhesive film may be equipped with protection means such as e.g. a plastic cover that is to be removed by a user before connecting the opening device to a face of the capsule.

Alternatively, the adhesive may be applied as a separate element to the kit, e.g. in a separate tube. Thereby, the adhesive may be applied by a user before the association of the opening device to a particular capsule of the kit.

In a preferred embodiment, the capsule opening device further comprises engagement means which are designed to be selectively connectable at least to a portion of the outlet face of the capsule and which are arranged movably with respect to the means for mechanically associating the opening device to the capsule.

Thereby, the engagement means is preferably a suction member designed for separating at least said portion from the outlet face of the capsule upon motion relative to the means for mechanically associating the opening device to the capsule.

Hence, effective deflection of at least said portion of the outlet face of the capsule with regard to the rest of the outlet face is enabled. Thereby, the engagement means may be designed to tear and/or shear a portion of the outlet face with regard to the rest of the outlet face in order to create an opening therein.

In a second aspect, the present invention relates to a capsule opening device for opening a capsule containing nutritional ingredients, preferably infant formula ingredients, the opening device comprising means for mechanically associating the opening device to the capsule, preferably without using tools, the capsule opening device comprising an integrally formed opening member arranged to be operated by a user and designed for being moved relatively to an outlet face of the capsule at least from a first storage position into a second opening position.

Accordingly, an easily transportable and reusable device is provided which enables a user to open capsules containing nutritional ingredients independent of a stationary system. Hence, a user is enabled to conveniently serve the ingredients provided within such a capsule to a dedicated receiving vessel and thus prepare the nutritional composition upon addition of liquid to the ingredients at any desired location.

In a preferred embodiment, the opening member of the device is designed for selectively being moved within a plane essentially parallel to the outlet face of the capsule. Thereby, the opening member is preferably of essentially plate-shaped form. Accordingly, a very space saving arrangement of the opening device is enabled.

The opening device preferably comprises a funnel, movably arranged with respect to the means for mechanically associating the opening device to the capsule, for receiving the nutritional ingredients from the capsule.

The funnel is preferably integrally formed with the opening device and arranged to be connectable at least to an outlet face of the capsule. Hence, the user may connect the funnel to the outlet face of the capsule either before or after opening the outlet face by means of the opening member in order to accurately serve the ingredients from the capsule to a dedicated receiving vessel.

Alternatively, the opening member of the device may be integrally formed with the funnel of the device.

The funnel of the device may comprise integrally formed dosing means which enable a user to provide a predefined amount of ingredients to an outlet of the funnel and thus to a receiving vessel. Hence, the user may individually choose the dosage, e.g., the amount of ingredients provided from the capsule, to a dedicated receiving vessel.

In a third aspect, the present invention relates to a method for opening a capsule containing nutritional ingredients, preferably infant formula ingredients, the capsule having a cup-like base body comprising an opening being closed off by an outlet face, the method comprising the steps of:

- mechanically connecting an opening device to at least a portion of a capsule,
- penetrating the outlet face of the capsule by means of an opening member, and
- creating an aperture in the outlet face of the capsule by selectively moving the opening member with respect to the outlet face.

Accordingly, a method for a rapid and convenient opening of a preferably sealed capsule containing nutritional ingredients is provided.

In a preferred embodiment, the method further comprises the step of moving the opening member along a plane essentially parallel to the outlet face of the capsule. Thereby, the opening member preferably cuts the outlet face of the capsule. Accordingly, a user is enabled to effortlessly create an aperture in the outlet face.

The motion path followed by the opening member is preferably of arc-shaped or essentially semicircular form. However, the motion path may be of different form suitable for creating a cut within the outlet face of the capsule such that the ingredients provided within the capsules can be served from the opening defined by the cut.

The method preferably further comprises the step of selectively connecting a suction member to at least a portion of the outlet face of the capsule. Thereby, the suction member is preferably connected to a portion adjacent to a cut created within the outlet face of the capsule. Hence, the suction member may be used to shear, e.g., tear, a portion of the outlet face. Thereby, the tearing or shearing by means of the suction member may be assisted by the cut created within the outlet face.

After providing the nutritional ingredients from the capsule to a dedicated receiving vessel, a user may provide cold or hot liquid to the vessel in order to reconstitute the nutritional composition. Thereby, the ingredients are preferably reconstituted with water. However, the ingredients may as well be reconstituted with liquid selected from milk, juices, etc. Hence, a reconstitution of the nutritional composition is enabled independent of a dedicated beverage preparation machine.

BRIEF DESCRIPTION OF THE DRAWINGS

Further features, advantages and objects of the present invention will become apparent for the skilled person when reading the following detailed description of embodiments of the present invention, when taken in conjunction with the figures of the enclosed drawings.

DETAILED DESCRIPTION OF THE FIGURES

FIGS. 1*a* to 1*f* relate to schematic drawings of a capsule 10 and the capsule opening device 1 of the kit according to the present invention. In particular, the FIGS. 1*a* to 1*f* relate to different steps during interaction of the capsule 10 and the opening device 1 during operation by a user.

Figures 1A, 1B, 1C, 1D, 1E, 1F:
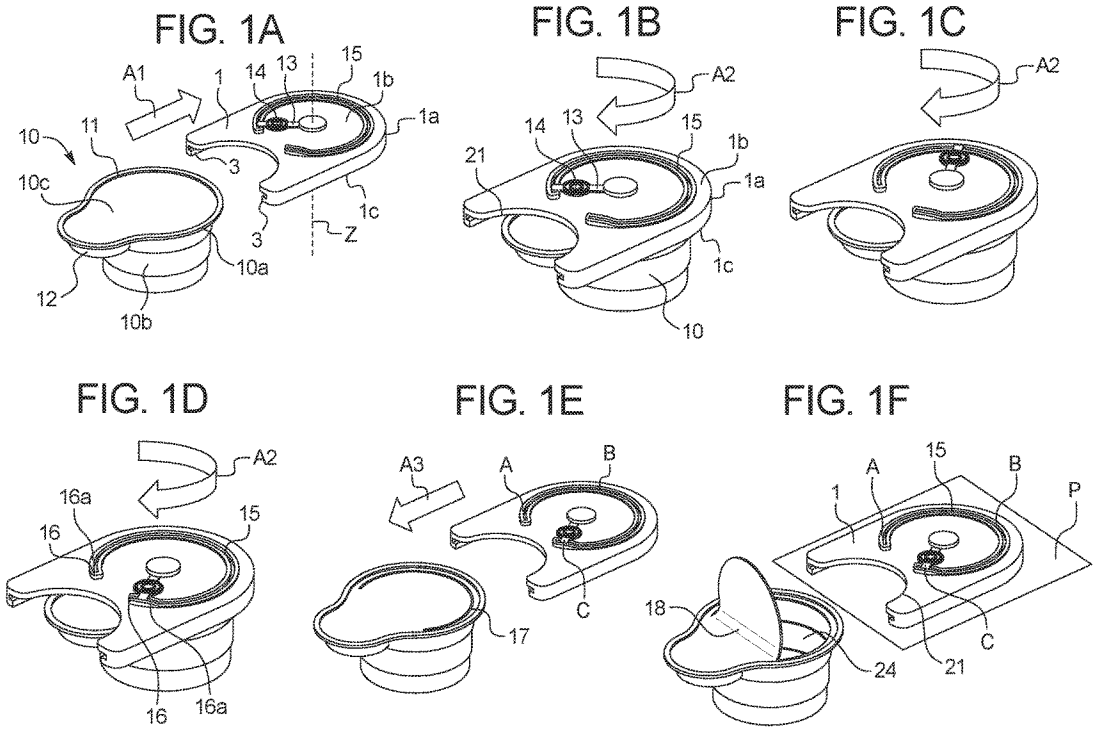
FIG. 1*a* to 1*f* show schematic drawings of a capsule and the capsule opening device of the kit according to the present invention in perspective side view. Thereby, the figures relate to different steps during interaction of the capsule and the opening device.

FIG. 1*a* shows the capsule 10 and the opening device 1 in their non-associated state. As can be seen in the figures, the capsule 10 generally comprises a body portion 10*b* which is preferably cup-shaped and which comprises at least an aperture 11 at a top portion of the body portion 10*b*. The capsule further comprises a flange-like rim portion 10*a* surrounding the aperture 11 to which an outlet face 10*c*, for example a top membrane or foil, is sealed. It should be noted that the outlet face 10*c* may be simply liquid impervious or, most preferably, liquid and gas impervious. In particular, the membrane of the outlet face 10*c* can be a multi layer comprising EVOH and/or aluminum. Preferably, the outlet face 10*c* is made of a thin polymer and/or aluminum.

Although the outlet face 10*c* has the function of serving the nutritional ingredients after opening thereof, said outlet face 10*c* may as well be referred to as inlet face due to its function to enable the injection of liquid by means of a dedicated preparation machine into which the capsule is insertable.

At a bottom portion of the cup-shaped body portion 10*b* of the capsule 10, and thus, opposite to the outlet face 10*c*, an outlet 30 (see FIG. 4*e*) for the release of the liquid nutritional composition/product from the capsule may be formed. Thereby, the outlet 30 may comprise one or several openings for streaming of the liquid composition towards a dedicated receiving vessel when the capsule is used in conjunction with a dedicated beverage production machine. It should be noted that the capsule 10 is generally adapted for being used in conjunction with such a beverage production machine.

At an upper side of the body portion 10*b*, an extension portion 12 is formed which is preferably designed for receiving filter means for filtering liquid supplied to the capsule 10 by means of a dedicated beverage production machine.

In the cup-shaped portion 10*b* of the capsule a compartment for containing nutritional ingredients 23 (see FIG. 5*b*) is preferably formed by the bottom and sidewall of the cup-shaped body portion 10*b*. Thereby, the volume of the compartment may vary depending on volume of liquid to be injected into the capsule.

The capsule opening device 1 of the kit is of essential plate-like shape and comprises connection means 3 integrally formed with the body of the opening device 1. Thereby, the connection means 3 is preferably a connection grove formed in an outer rim portion 1*a* of the opening device 1 and having a U-shaped cross section which is designed to interact with the rim portion 10*a* of the capsule 10. Thereby, the connection grove 3 is opened to at least one side of the capsule opening device 1 such that the opening device 1 can be slidably attached to the rim portion 10*a* of the capsule 10 as indicated by arrow A1 in FIG. 1*a*.

The capsule opening device 1 is further equipped with an integrally formed opening member 13 supported by the body of the opening device 1 and rotationally moveable around a central axis Z thereof.

The opening member 13 is preferably arranged at an upper surface 1*b* of the opening device 1 which is arranged opposite to a lower surface 1*c* thereof, to which the capsule 10 is connected in an associated state of the capsule 10 and the opening device of the kit as shown in FIG. 1*b*.

The opening member 13 preferably comprises handling means 14 which enable a user to operate the opening member 13. The handling means 14 is preferably a button-shaped member integrally formed with the opening member 13 which is large enough to enable a handling of the opening member 13 by means of a finger tip of a user.

At an outer portion of the opening member 13 a cutting blade 2 (see FIGS. 2*c* and 4*c*) is attached which extends from the upper surface 1*b* on which the handling means 14 are moveably arranged to the lower surface 1*c* of the opening device 1.

As shown in the FIGS. 1*a* to 1*f*, the cutting blade 2 is movably arranged within a guiding support groove 15 extending from the upper surface 1*b* to the lower surface 1*c* of the capsule opening device 1.

The support grove 15 is preferably of essentially arc-shaped from. However, the support groove may as well be of semi-circular form for example.

A user is thus enabled to move the opening member 13 along a motion path of the cutting blade 2 guided by the support groove 15. Thereby, the cutting blade 2 preferably comprises at least a storage position A and an opening position B. More preferably, the motion path preferably comprises two storage positions A, C which are provided at the respective ends of the motion path of the cutting blade 2 (see FIG. 1*e*).

Figure 2A:
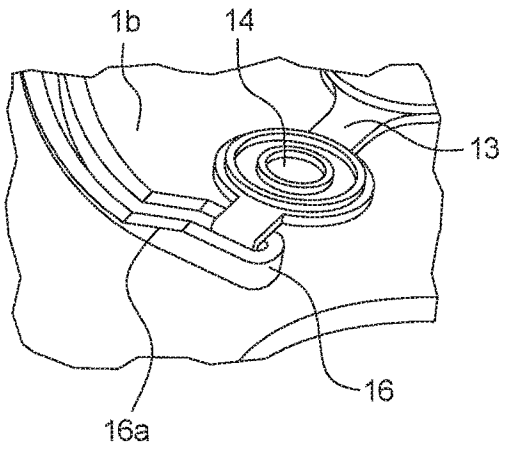
FIGS. 2*a* to 2*c* show detailed perspective side views of the opening member of the opening device according to FIGS. 1*a*, 1*b* and 1*c*
Figure 2B:
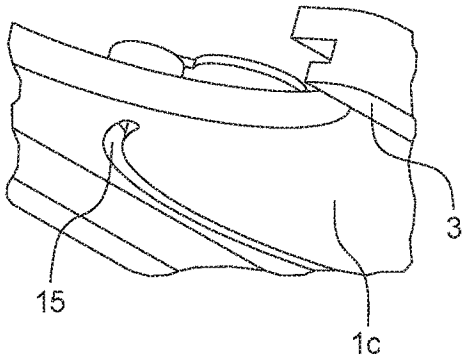
Figure 2C:
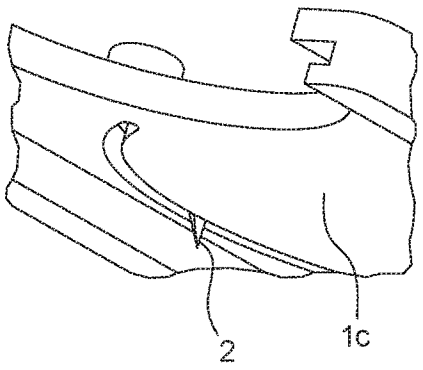

As indicated in FIGS. 2*a* and 2*b*, when the cutting blade 2 is in its storage position A or second storage position C, the cutting plate 2 is not protruding from the lower face 1*c* of the capsule opening device 1 (see FIG. 2*b*). This is due to a storage member 16 which is preferably integrally formed with the upper surface of the opening device 1 and which protrudes from said upper surface 1*b* such that the cutting blade 2 does not protrude from the lower surface 1*c* of the opening device 1. Hence, in said storage position, a user is effectively prevented from cutting himself during handling of the opening device 1.

When the opening member 13 is moved along its motion path, as indicated by arrow A2 in FIG. 1*b* to 1*d*, the cutting plate 2 is moved essentially orthogonal to the outlet face 10*c* of the capsule 10 as the opening member 13 is guided from supporting position at the storage member 16 by means of a ramp 16*a* to the upper surface 1*b* of the opening device 1. Thereby, the blade 2 is continuously protruding to a further extend from the lower face 1*c* of the capsule opening device 1 such that when a capsule 10 is associated to the opening device 1 as shown in FIG. 1*b*, the blade 2 is made to pierce, e.g., to cut into, the upper face 10*c* of the capsule 10.

During the further movement of the cutting member 13 along its motion path as indicated in FIG. 1*c*, an arc-shaped cut 17 (see FIG. 1*e*) is produced in the outlet face 10*c* of the capsule 10. At the end of the motion path followed by the cutting member 13, the cutting blade 2 is brought from an opening position B to a second storage position C by means of a second storage member 16 formed at the end of the support groove 15. Thereby, in order to enable a smooth disconnection of the blade 2 from the outlet face 10*c* of the capsule 10, a ramp 16*a* is provided between the support grove 15 and the storage member 16. Thus, the cutting blade is continuously retracted from the outlet face 10*c* of the capsule 1 due to said ramp 16*a*.

It should be noted that in order to enable such a relative movement between the upper surface 1*b* of the opening device 1 and the opening member 13, the opening member 13 is to be at least partially flexible with respect to the upper surface 1*b* of the device 1.

During the movement of the cutting blade 2 within the support groove 15, the opening member 13 is preferably moved along a motion path essentially parallel to a plane P (see FIG. 1*f*) which is essentially parallel arranged to the lower surface 1*c* of the opening device 1 and thus, essentially parallel to the outlet face 10*c* of the capsule 10 when the capsule 10 is in its associated state to the opening device 1. Accordingly, a very compact design of the opening device 1 is provided.

As shown in FIG. 1*e*, after the cutting member 13 is brought in storage position C, the user is enabled to easily detach the opening device 1 from the capsule 10 as indicated by arrow A3. Thereby, in order to enable a facilitated connection and disconnection of the capsule 10 and the opening device 1, the opening device comprises a recess 21 from which the circumferential rim portion 10*a* of the capsule 10 is at least partially protruding such that a user is enabled to grip the protruding rim portion 10*a* of the capsule 10 with his fingers in order to connect or disconnect the capsule 10 to the opening device 1.

Further, since an arc-shaped cut 17 has now been produced in the outlet face 10*c* of the capsule 10, a user is enabled to open the capsule 10 by folding, e.g., bending, the outlet face 10*c* around an edge 18 between the ends of the cut 17. Since an opening 24 is now produced in the outlet face 10*c* of the capsule 10, a user is now enabled to serve the ingredients within the capsule body portion 10*b* to a dedicated glass or receiving vessel.

FIGS. 3*a* to 3*f* relate to another preferred embodiment of the kit according to the present invention, wherein the opening device 1 comprises a funnel member 5. As can be seen in FIGS. 3*a* to 3*f*, the opening device 1 comprises an upper portion 26 which is essentially formed of the plate-like opening member 1 according to the first embodiment as described with reference to FIGS. 1*a* to 1*f*, and a lower portion 27 which comprises the funnel member 5. Thereby the upper portion 26 and the lower portion 27 are preferably attached by joint member 19 which enables a relative motion of the upper portion 26 and the funnel 5. The opening member 1 according to said embodiment can preferably assume at least two positions of the upper portion 26 and the lower portion 27. Thereby, FIG. 3*a* refers to a storage position of the opening member 1 in which the upper portion 26 is arranged on top of the lower portion 27, thereby closing off the upper aperture 5*a* of the funnel 5.

Figures 3A, 3B, 3C, 3D, 3E, 3F:
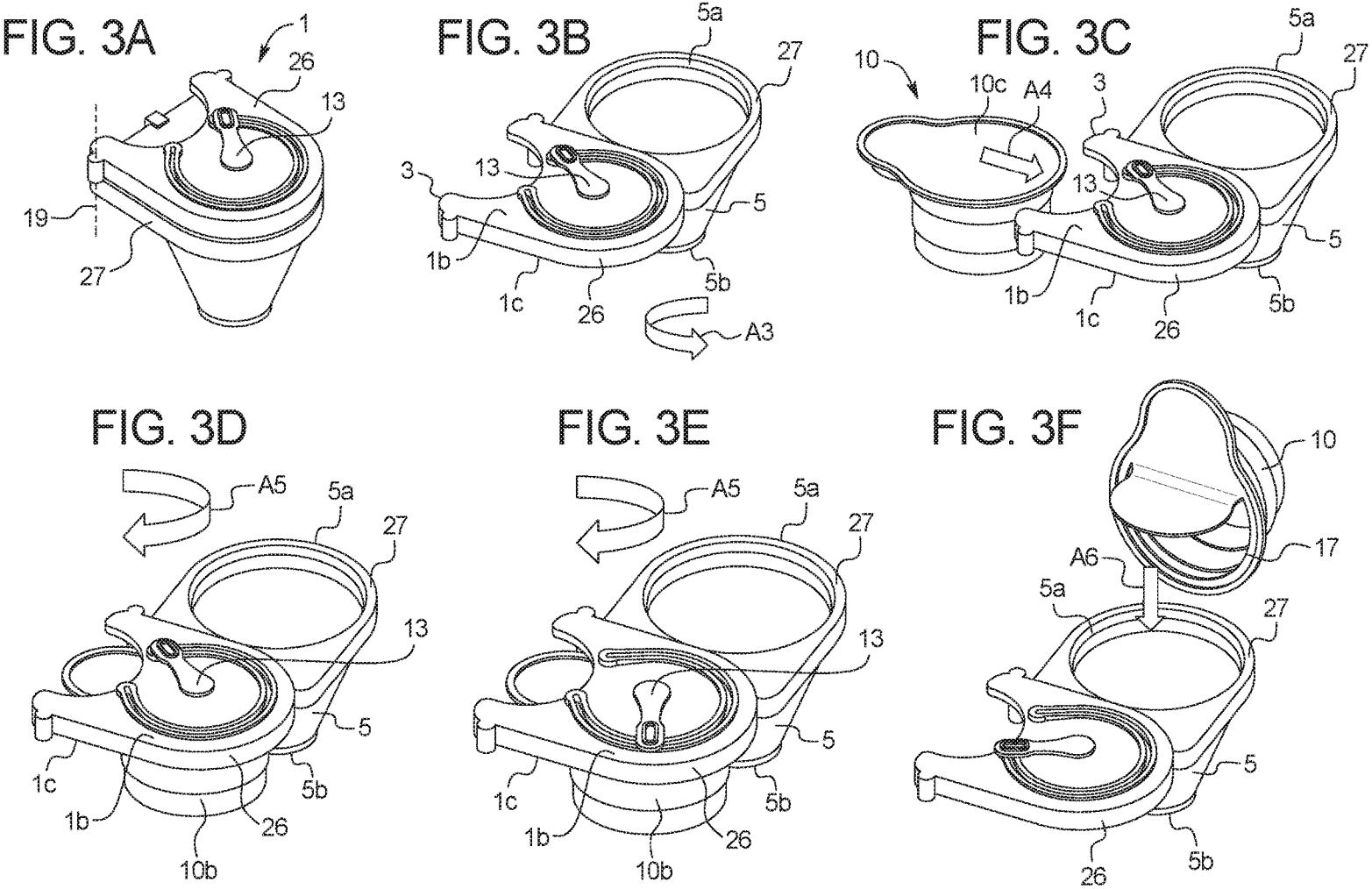
FIGS. 3*a* to 3*f* relate to another preferred embodiment of the kit according to the present invention, wherein the opening device is equipped with an integrally formed funnel member.

Upon movement about the pivot axis (arrow A3) of the joint member 19, the upper portion 26 may be brought from the storage position into a second capsule opening position as indicated in FIG. 3*b*. Thereby, a lower face 1*c* of the upper portion 26 is brought to a position offset to the lower portion 27 comprising the funnel member 5 such that a capsule 10 may be connected to the dedicated connection means 3 provided at the lower surface 1*c* of the opening device 1 (arrow A4). This essentially corresponds to the association of the capsule 10 and the opening device 1 as described with reference to FIGS. 1*a* to 1*f*.

As indicated in FIGS. 3*d* and 3*e*, in the state in which the capsule 10 is associated to the opening device, the opening member 13 is operated by a user in order to cut a predefined cut 17 corresponding to the support grove 15 of the opening device 1 into the outlet face 10*c* of the capsule 10 as indicated by arrow A5.

After the capsule 10 is detached from the connection means 3 of the capsule opening device 1, ingredients 23 may be served from the capsule 10 to the upper opening 5*a* of the funnel 5 (arrow A6) such that the ingredients 23 are funneled down to the lower opening 5*b* from which a dosage to a dedicated glass or receiving vessel is enabled. Thereby, the funnel 5 may comprise integrally formed dosing means (not shown) which enable a user to serve a predefined amount of ingredients from the lower opening 5*b* of the funnel 5. The dosage means may for example comprise a manually operable valve member.

FIGS. 4*a* to 4*e* relate to another preferred embodiment of the kit according to the present invention, wherein the capsule opening means 1 comprise funnel means 5 having an integrally formed opening member 2. Thereby, as can be particularly seen in FIGS. 4*a* to 4*c*, the opening device 1 comprises a first and a second enclosing member 20*a*, 20*b*.

Figure 4C:
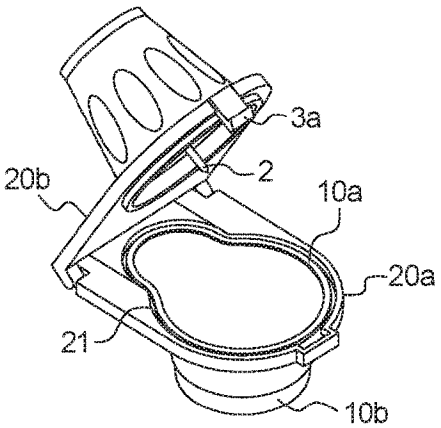
FIGS. 4*a* to 4*e* relate to another preferred embodiment of the kit according to the present invention, wherein the capsule opening means comprise funnels means having an integrally formed opening member.
Figure 4B:
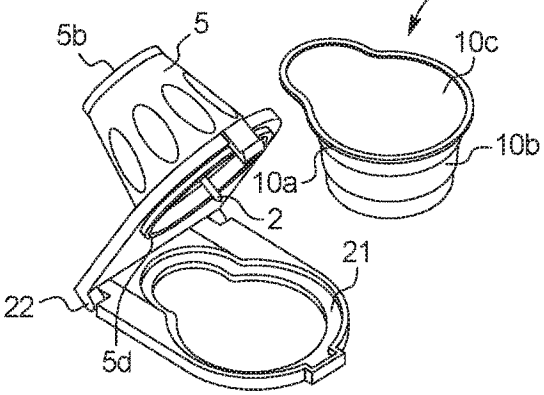
Figure 4A:
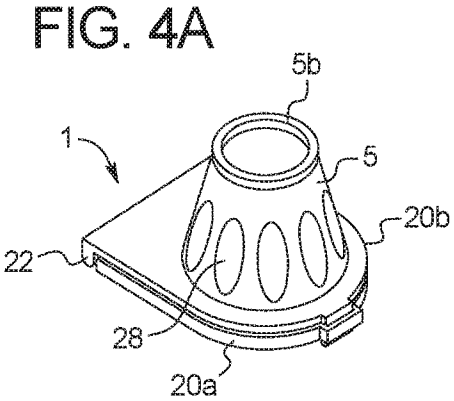

The first enclosing member 20*a* is pivotally connected to the second enclosing member 20*b* by means of a joint 22. The first enclosing member 20*a* comprises positioning means 21 correspondingly shaped to the rim portion 10*a* of the capsule 10 and suitable for interacting with said rim portion 10*a* in order to support a capsule 10 placed therein. When being brought from their engagement position as shown in FIG. 4*a* to the capsule insertion position as shown in FIG. 4*b*, a capsule 10 may be provided to the first engagement member 20*a* of the opening device as shown in FIGS. 4*b* and 4*c*. After the capsule 10 has been provided to the first engagement member 20*a*, the opening device 1 is brought to its capsule engagement position as shown in FIG. 4*d*.

Connection means 3*a* which are preferably provided at a portion of the opening device 1 opposite to the joint 22, enable a stable connection between the first and second engagement members 20*a*, 20*b*. Thereby, the connection means 3*a* is preferably a reclosable snatch member suitable for fixedly engaging the first and second engagement members 20*a*, 20*b*.

Figure 4E:
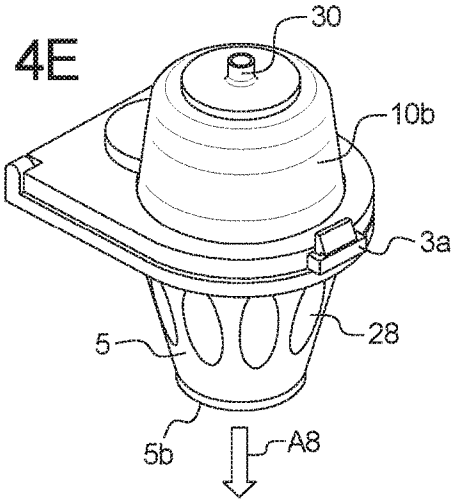
Figure 4D:
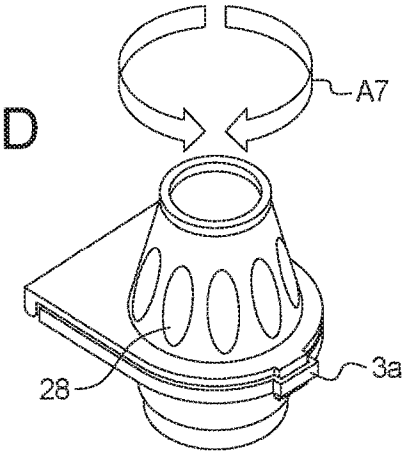

In its engagement position as shown in FIG. 4*d*, a blade protruding from an inner side of the funnel 5 integrally formed with the second engagement member 20*b* is pinched, e.g., cut into, the outlet face 10*c* of the capsule 10. Then, a user will rotate the funnel member 5 with respect to the first and second engagement members 20*a*, 20*b* and thus with respect to the outlet face 10*c* of the capsule 10 such that a circular opening is cut into the outlet face 10*c* of the capsule 10 (see arrows A7). For this purpose, the funnel 5 is preferably rotatable supported by means of the second enclosing member 20*b*. For facilitating the rotational movement of the funnel 5 with respect to the first and second engagement members 20*a*, 20*b*, the funnel preferably comprises circumferentially arranged recesses 28 for supporting the fingers of the user during rotation.

In a further step as depicted in FIG. 4*e*, a user may rotate the opening device 1 such that the funnel member 5 is facing with its outlet opening 5*b* downwards, thereby releasing the ingredients from the capsule 10 by means of the circular opening created in the outlet face 10*c*. Hence, the ingredients contained within the capsule 10 may be easily and conveniently provided by means of the funnel member 5 towards a provided receptacle (see arrow A8).

Figure 5B:
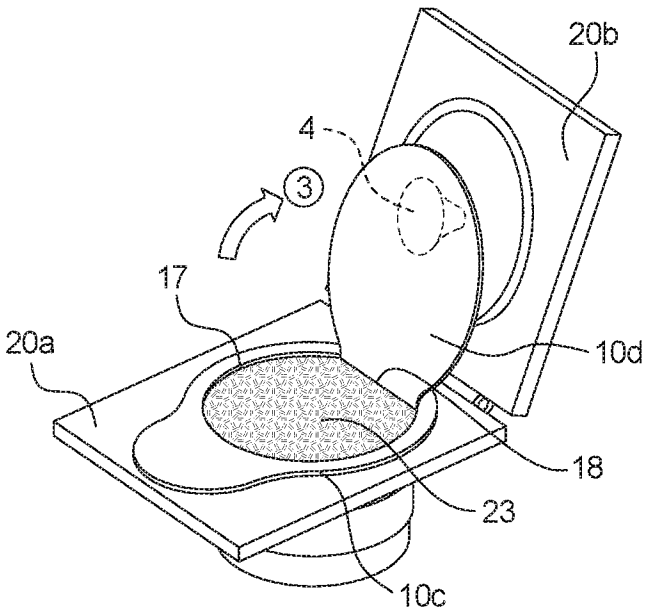
FIGS. 5*a* and 5*b* relate to another preferred embodiment of the kit according to the present invention, wherein the capsule opening means additionally comprise engagement means suitable for interacting at least with a portion of the outlet face of the capsule.
Figure 5A:
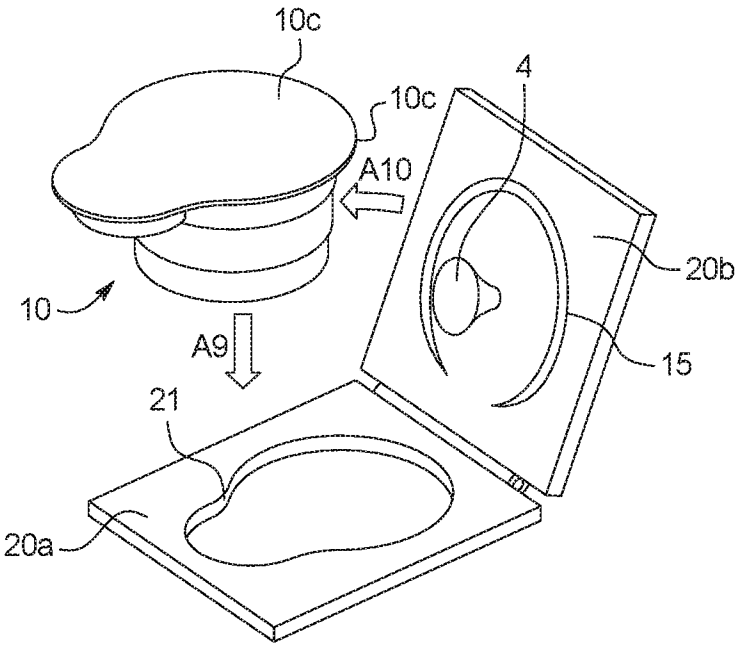

FIGS. 5*a* and 5*b* relate to another preferred embodiment at the opening device 1 of the present invention, wherein the capsule opening device 1 additionally comprises engagement means 4 suitable for interacting at least with a portion 10*d* of the outlet face 10*c* of the capsule 10.

In this embodiment, the capsule 10 is placed into dedicated positioning means 21 of the first engagement member 20*a* (see arrow 9). Then, the second engagement member 20*b* is brought into a capsule insertion position (see arrow A10) corresponding to the position as shown in FIG. 4*c*. Thereby, a suction member 4 provided at an lower surface of the engagement member 20*b* interacts with a portion 10*d* of the outlet face 10*c* of the capsule 10 such that the portion 10*d* is sucked towards the suction member 4.

Hence, during opening of the opening device 1, e.g., during separation of the first and second engagement member 20*a*, 20*b*, the portion 10*d* of the outlet face 10*c* stays sucked towards that suction member 4, thereby rupturing the portion 10*d* of the outlet face 10*c* in order to create an opening 24 therein.

Before the separation of the first and second engagement members 20*a*, 20*b* the cutting member 2 may be used in order to create a cut 17 in the outlet face of the capsule 10. Hence, after separation of the first and second engagement members 20*a*, 20*b*, a very accurate large aperture is provided at the outlet face 10*c*, whereby the portion 10*d* is bent about a fold line 18 present between the ending of the cut 17.

Thus, a convenient serving of the ingredients 23 contained within the body portion 10*b* of the capsule 10 is enabled.

After serving of the ingredients 23 from the capsule, the user may easily detach the portion 10*d* from the suction member 4 and release the capsule 10 from the positioning means 21.

FIGS. 6*a* to 6*g* relate to another preferred embodiment of the kit according to the present invention similar to the embodiment according to FIGS. 4*a* to 4*e* and wherein the capsule opening means 1 further comprise a cover member 31.

The cover member 31 is preferably arranged to close-off the capsule opening means 1 in its storage position as shown in FIG. 1. The cover member 31 thus comprises a lid portion 31*b* being preferably of complementary shape to the funnel member 5, e.g., the enclosing member 20*a*, such that an effective protection of the interior of the opening means 1 is obtained by the cover member 31 in its storage position.

The cover member 31 further comprises a lever portion 31*a* integrally formed with the cover member 31. Thereby, the lever portion 31*a* is preferably protruding from a portion of the cover member 31 away from the lid portion 31*b*. The lever portion 31*a* is preferably a hook-like portion arranged about a joint 32 of the cover member 31. Thereby, the hook-like portion is preferably complementary formed to a body portion 10*b* and/or to a portion of the outlet face 10*c* of the capsule 10 with which it is to interact upon movement of the cover member 31.

The cover member 31 is preferably connected to the capsule opening means 1 by means of the joint 32. Thereby, the joint 32 is arranged to rotatably connect the cover member 31 to at least one of the first and second enclosing members 20*a*, 20*b*. The joint 32 is preferably arranged in parallel and offset to the joint 22 connecting the first and the second enclosing member 20*a*, 20*b*.

As shown in FIGS. 6*b* to 6*f*, the cover member 31 is brought into an opening position (arrow A9) by rotation about joint 31. Subsequently, the first and second enclosing members 20*a*, 20*b* are separated by a rotation about joint 22 (arrow A10). The capsule 10 is then placed into the opening means 1 before the first and second enclosing members are brought into their closing position again (arrow A11) such that the protruding blade 2 interacts with the outlet face 10*c* of the capsule 10, e.g. pierces the outlet face 10*c*. Thereby, the first and second enclosing members 20*a*, 20*b* are preferably engaged by means of provided connection means 3*a*.

The opening means 1 are then flipped upside-down (arrow A12) such that the funnel 5 is facing downwards. In a next step, the funnel 5 is rotated by a user (arrow A13) such that the blade 2 creates an aperture within the outlet face 10*c* of the capsule 10.

Figures 6A, 6B, 6C, 6D, 6E, 6F, 6G:
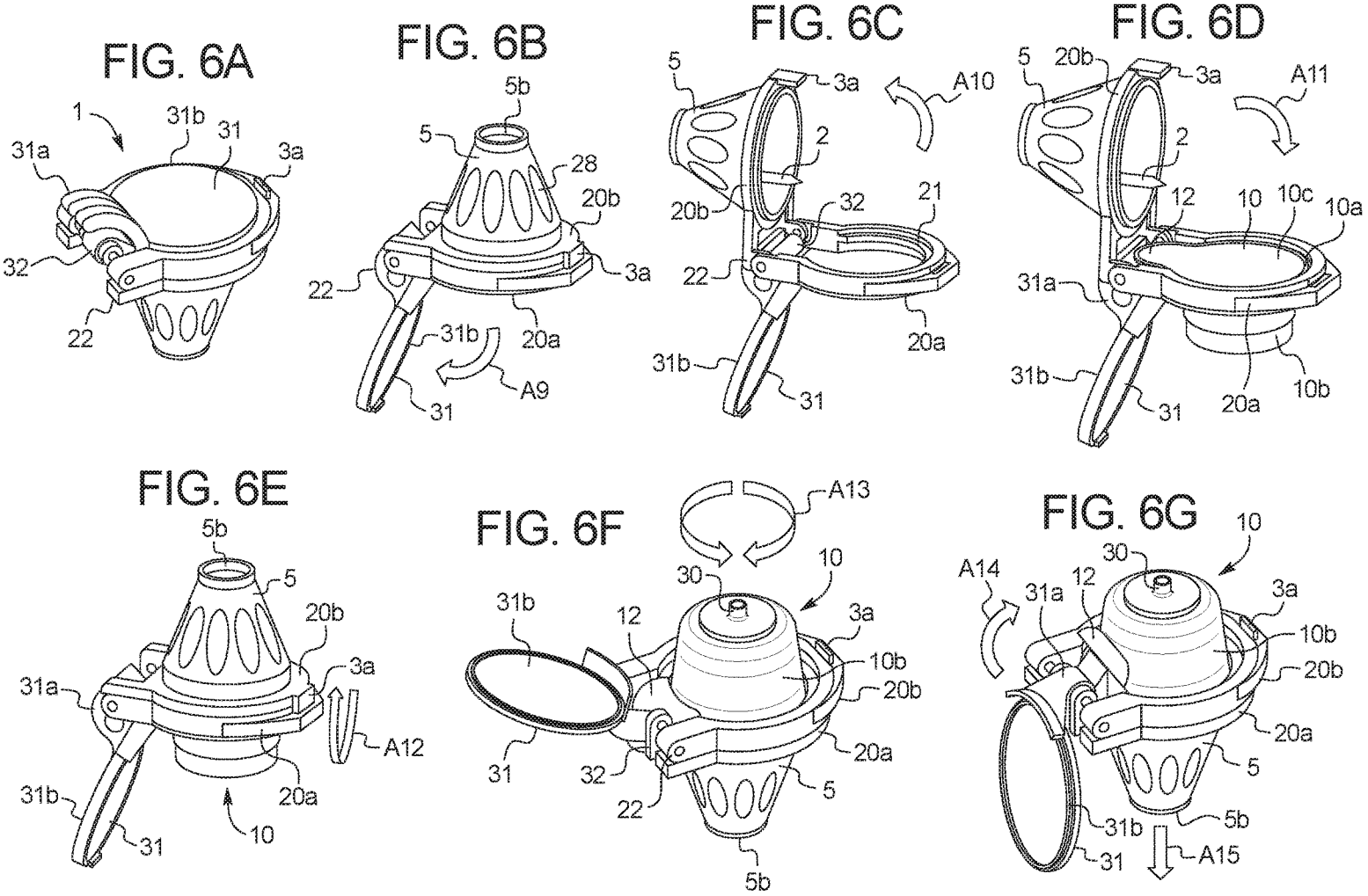
FIGS. 6*a* to 6*g* relate to another preferred embodiment of the kit according to the present invention, wherein the capsule opening means further comprises a dedicated cover member.

As shown in FIG. 6*g*, the cover member 31 is then rotated by a user about joint 32 such that the lever portion 31*a* of the cover member 31 interacts with at least an outer portion of the capsule 10.

In a preferred embodiment as shown in FIG. 6*g*, the lever portion 31*a* is designed to interact upon movement about joint 32 with a portion of the capsule outlet face 10*c* and/or a portion of the capsule arranged in vicinity of the outlet face 10*c*, such as e.g. the extension portion 12 formed at an upper side of the body portion 10*b*.

Hence, a force is applied onto the capsule body 10*b* and/or the outlet face 10*c* by means of the interaction of the lever portion 31*a* with the portion of the capsule 10 which leads to an effective ejection of the composition from the capsule 10 towards the funnel 5 from which the composition may then be provided (arrow A15) to e.g. a receptacle (not shown). Thereby, the force applied by the lever portion 31*a* is preferably a compressive and/or shearing force (arrow A14) which leads to a widening of the aperture created in the outlet face 10*c* by means of the blade 2. Thus, the exit of the composition from the capsule 10 towards the funnel 5 is essentially facilitated.

It is to be noted that the lever portion 31*a* may be of any particular shape suitable for providing a dedicated force onto at least a portion of the capsule 10 upon rotation of the cover member 31 about joint 32.

The invention claimed is:

1. A kit comprising:

a capsule configured to be inserted in a beverage production machine and containing nutritional ingredients, the capsule having a rim portion and a cup-like base body comprising an opening that is closed by an outlet face; and a capsule opening device provided separately to the capsule, the capsule and the capsule opening device having a member for mechanically associating the capsule opening device to the capsule by a consumer, to form an associated configuration of the kit, the capsule opening device comprising an integrally formed opening member arranged to be operated by a user and configured to open the outlet face of the capsule, the capsule opening device comprises a body configured to support the integrally formed opening member, the integrally formed opening member is configured to rotate relative to the body of the capsule opening device in a direction parallel to the outlet face of the capsule to open the outlet face in the associated configuration of the kit, and the integrally formed opening member comprises cutting means for opening by cutting the outlet face, the capsule opening device further comprising a first enclosing member and a second enclosing member, the first enclosing member is pivotally connected to the second enclosing member by a joint, and the first enclosing member comprises a connection member correspondingly shaped to the rim portion of the capsule and configured to interact with the rim portion and support the capsule placed therein.

2. The kit according to claim 1, wherein the integrally formed opening member can move from a first storage position to a second opening position.

3. The kit according to claim 1, wherein the integrally formed opening member is movable relative to the member for mechanically associating the capsule opening device to the capsule.

4. The kit according to claim 1, wherein the capsule opening device is a separate element designed to be selectively applicable to the capsule.

5. The kit according to claim 1, wherein the capsule opening device comprises a connection member designed for selectively connecting the capsule opening device to, and/or disconnecting the capsule opening device from the rim portion of the capsule.

6. The kit according to claim 5, wherein the connection member is a clip member or a connection groove.

7. The kit of claim 1, wherein the opening member is configured to rotate around a central axis of the body of the capsule opening device.

8. The kit of claim 1, wherein the integrally formed opening member is movably arranged within a guiding support groove extending from an upper surface to a lower surface of the body of the capsule opening device.

9. The kit of claim 8, wherein at least one end of the guiding support groove comprises a storage position formed by a storage member protruding from the upper surface of the body such that the integrally formed opening member is retracted within the guiding support groove when the integrally formed opening member is positioned on the storage member.

10. A capsule opening device for opening a capsule containing nutritional ingredients, the capsule opening device comprising:

a member for mechanically associating the capsule opening device to the capsule;

an integrally formed opening member arranged to be operated by a user and movable relatively to an outlet face of the capsule at least from a first storage position to a second opening position;

a body which supports the integrally formed opening member, the integrally formed opening member is configured to rotate relative to the body of the capsule opening device in a direction parallel to the outlet face of the capsule to open the outlet face when the capsule opening device is mechanically associated to the capsule, and the integrally formed opening member comprises cutting means for opening by cutting the outlet face; and a first enclosing member and a second enclosing member, the first enclosing member is pivotally connected to the second enclosing member by a joint, and the first enclosing member comprises a connection member correspondingly shaped to a rim portion of the capsule and configured to interact with the rim portion to support the capsule placed therein.

11. The capsule opening device according to claim 10, wherein the integrally formed opening member comprises a funnel movable with respect to the member for mechanically associating the capsule opening device to the capsule.

12. The capsule opening device of claim 10, wherein the opening member is configured to rotate around a central axis of the body of the capsule opening device.

13. A method for opening a capsule containing nutritional ingredients, the capsule having a rim portion and a cup-like base body comprising an opening that is closed by an outlet face, the method comprising, in order:

mechanically connecting an opening device to at least a portion of a capsule;

supporting the capsule by the opening device, the opening device comprising a first enclosing member and a second enclosing member, the first enclosing member is pivotally connected to the second enclosing member by a joint, and the first enclosing member comprises a connection member correspondingly shaped to the rim portion of the capsule and configured to interact with the rim portion to support the capsule placed therein;

penetrating the outlet face of the capsule by an opening member, the opening device comprises a body which supports the opening member; and creating an aperture in the outlet face of the capsule by selectively rotating the opening member relative to the body of the opening device in a direction parallel to the outlet face, and the opening member comprises cutting means for opening by cutting the outlet face.

14. The method of claim 13, wherein the selectively rotating the opening member relative to the body of the opening device comprises selectively rotating the opening member around a central axis of the body of the opening device.

* * * * *